US005641910A

United States Patent [19]

Middleton

[11] Patent Number: 5,641,910

[45] Date of Patent: Jun. 24, 1997

[54] ELECTRODYNAMIC TRANSDUCER SHAKER AND METHOD FOR ITS MANUFACTURE

[75] Inventor: Bennie R. Middleton, Friendswood, Tex.

[73] Assignee: Dynamic Instruments, Inc., San Diego, Calif.

[21] Appl. No.: 258,948

[22] Filed: Jun. 13, 1994

[51] Int. Cl.[6] ..... H04R 9/06

[52] U.S. Cl. ..... 73/668

[58] Field of Search ..... 381/162; 73/662, 73/663, 668, 665

[56] References Cited

U.S. PATENT DOCUMENTS

| | | | |
|---|---|---|---|
| 5,002,065 | 3/1991 | LaCourse | 73/663 |
| 5,138,884 | 8/1992 | Bonavia | 73/665 |
| 5,226,326 | 7/1993 | Polen | 73/579 |
| 5,383,349 | 1/1995 | Blake-Coleman | 73/580 |

OTHER PUBLICATIONS

"Ling Dynamic Systems Ltd." User Manual/Installation, Commissioning & Operating Vibrator Model 200 Series (Part No. 892071), no date.

*Primary Examiner*—Christine K. Oda
*Attorney, Agent, or Firm*—Brown, Martin, Haller & McClain

[57] ABSTRACT

A vibrator or shaker comprises an audio speaker and a mounting for attaching a payload to be vibrated. One end of the mounting is adhesively bonded to the outside of the speaker cone. The other end of the mounting has a threaded spindle for attaching the payload. A suspension member or spider may be attached at its edges to the speaker frame and at its center to the mounting. The suspension member increases the maximum payload weight that can be accommodated by relieving the speaker cone of a portion of the combined weight of the payload, the mounting, and the moving speaker armature.

22 Claims, 2 Drawing Sheets

ELECTRODYNAMIC TRANSDUCER SHAKER AND METHOD FOR ITS MANUFACTURE

BACKGROUND OF THE INVENTION

The present invention relates generally to an apparatus for vibrating an article and, more specifically, to an economical electrodynamic vibrator for transducer test equipment.

Vibration of industrial machinery may be monitored by a system that includes a transducer and a measuring unit connected together by a cable. Test equipment for measuring the accuracy of such a system is well-known. The test equipment or test set includes a vibrator drive, often called a "shaker," which may be electrodynamic or electrohydraulic. The test set also includes an oscillator for exciting the shaker at a precisely regulated frequency and amplitude. To use the test set, an operator removes the transducer from the machinery on which it is mounted and mounts the transducer on the shaker while the transducer remains connected by its cable to its associated measuring unit. The shaker has a threaded spindle for facilitating mounting the transducer. The operator then activates the test set, which vibrates the transducer. The operator knows the frequency at which the test set is vibrating the transducer-under-test and can compare that value to the frequency measured by the measuring unit. The frequency and amplitude at which the test set vibrates may either be fixed or selectable by the operator. The test set may also measure other parameters, such as the acceleration, velocity, or sensitivity of the transducer-under-test. A reference accelerometer may be mounted on the shaker below the mounting spindle to measure the parameters or to provide a feedback signal to the oscillator. The test set typically includes a display for providing the measured parameters to the operator.

A typical electrodynamic shaker comprises a housing, a permanent magnet having a generally annular shape, and a wire coil armature assembly suspended within the opening in the magnet. The suspension comprises at least one leaf, often called a "spider," made of a stiff but resilient material such as plastic. Two such spiders, one at each end of the coil, may be used. The mounting spindle is attached to the armature. The components of such shakers are rugged yet built and assembled to precise tolerances. The precision armature assembly allows the shaker to produce a wide range of vibration frequencies, and the rugged structure allows the shaker to vibrate transducers having a wide range of weights. The manufacturing costs of producing such a shaker are correspondingly high. It would be desirable to provide a more economical shaker that may be used in test sets where extreme precision and wide frequency ranges are not critical requirements. These problems and deficiencies are clearly felt in the art and are solved by the present invention in the manner described below.

SUMMARY OF THE INVENTION

The present invention comprises a vibrator or shaker. The shaker may be used in a transducer test set or other system in which it is desired to vibrate an article at a predetermined frequency.

The shaker comprises an audio speaker and a mounting for attaching a payload, such as a transducer and/or reference accelerometer. The speaker may be a common audio speaker having a frame, a permanent magnet, a speaker cone, and a wire coil armature attached to the rear surface of the speaker cone. The payload mounting is attached to the outside of the speaker cone using any suitable method, such as adhesive bonding. The payload mounting may have a threaded spindle for attaching the payload to be vibrated.

A suspension member or spider may be attached at its edges to the speaker frame and at its center to the mounting to maximize the payload weight that the shaker can accommodate. The suspension member is preferably formed of a material that is resiliently movable in the direction of travel of the speaker cone but rigid in directions perpendicular to that direction. The suspension member increases the maximum payload weight that can be accommodated by relieving the speaker cone of a portion of the combined weight of the payload, the payload mounting, and the moving speaker armature.

The present invention can readily be manufactured using components and methods that are economical in relation to those used in electrodynamic shakers known in the art. The foregoing, together with other features and advantages of the present invention, will become more apparent when referring to the following specification, claims, and accompanying drawings.

BRIEF DESCRIPTION OF THE DRAWINGS

For a more complete understanding of the present invention, reference is now made to the following detailed description of the embodiments illustrated in the accompanying drawings, wherein.

DESCRIPTION OF A PREFERRED EMBODIMENT

Figure 1:
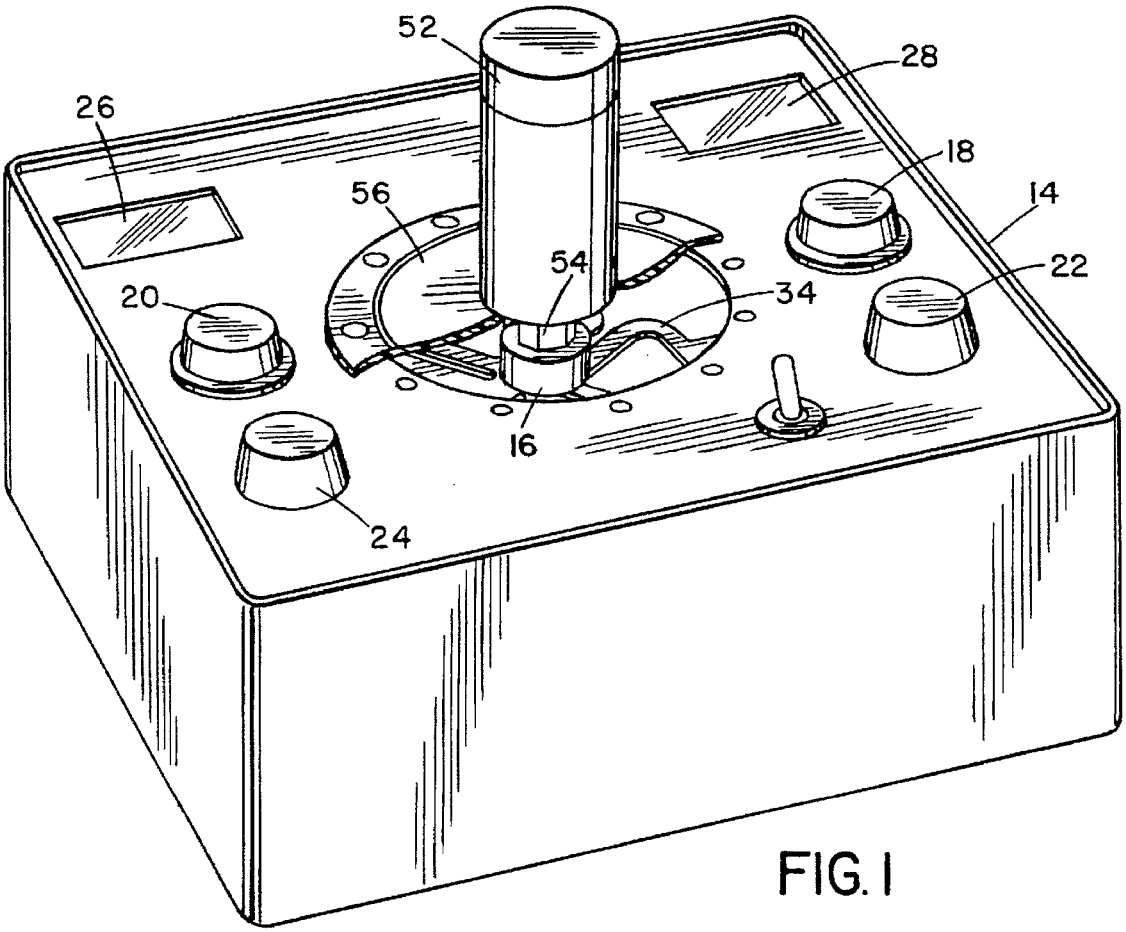
FIG. 1 is a perspective view, partially cut away, of a transducer test set having an electrodynamic shaker.
Figure 2:
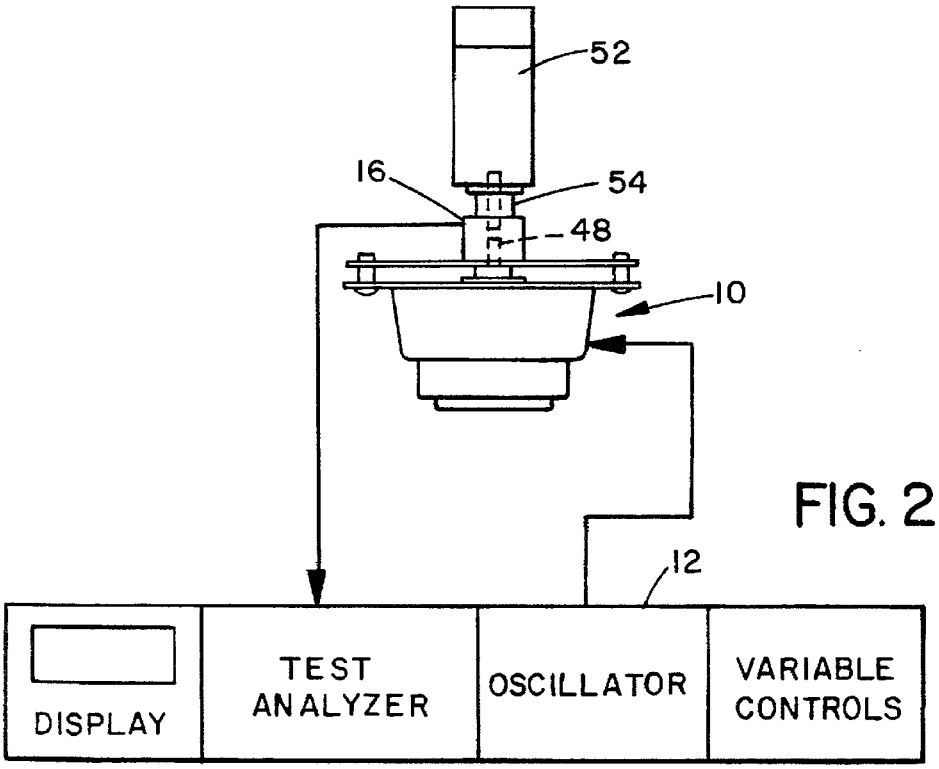
FIG. 2 is a diagrammatic view of the transducer test set electronics.

As illustrated in FIGS. 1 and 2, a transducer test set has a novel vibrator or shaker 10 and electronics 12 mounted in a housing 14. A reference accelerometer 16 is mounted on shaker 10, Electronics 12, which are well-known in the art and thus not described in detail herein, include a suitable oscillator circuit for driving shaker 10, a suitable analyzer circuit for receiving the output of accelerometer 16, and suitable circuits for interfacing the oscillator and analyzer circuits with controls and displays. The analyzer circuit preferably measures frequency and amplitude. The controls may include a frequency adjustment knob 18, an amplitude adjustment knob 20, a range selection knob 22, and a function selection knob 24. The displays 26 and 28 are preferably liquid crystal displays (LCDs) that provide digital indications of the measured frequency and amplitude, respectively.

Figure 3:
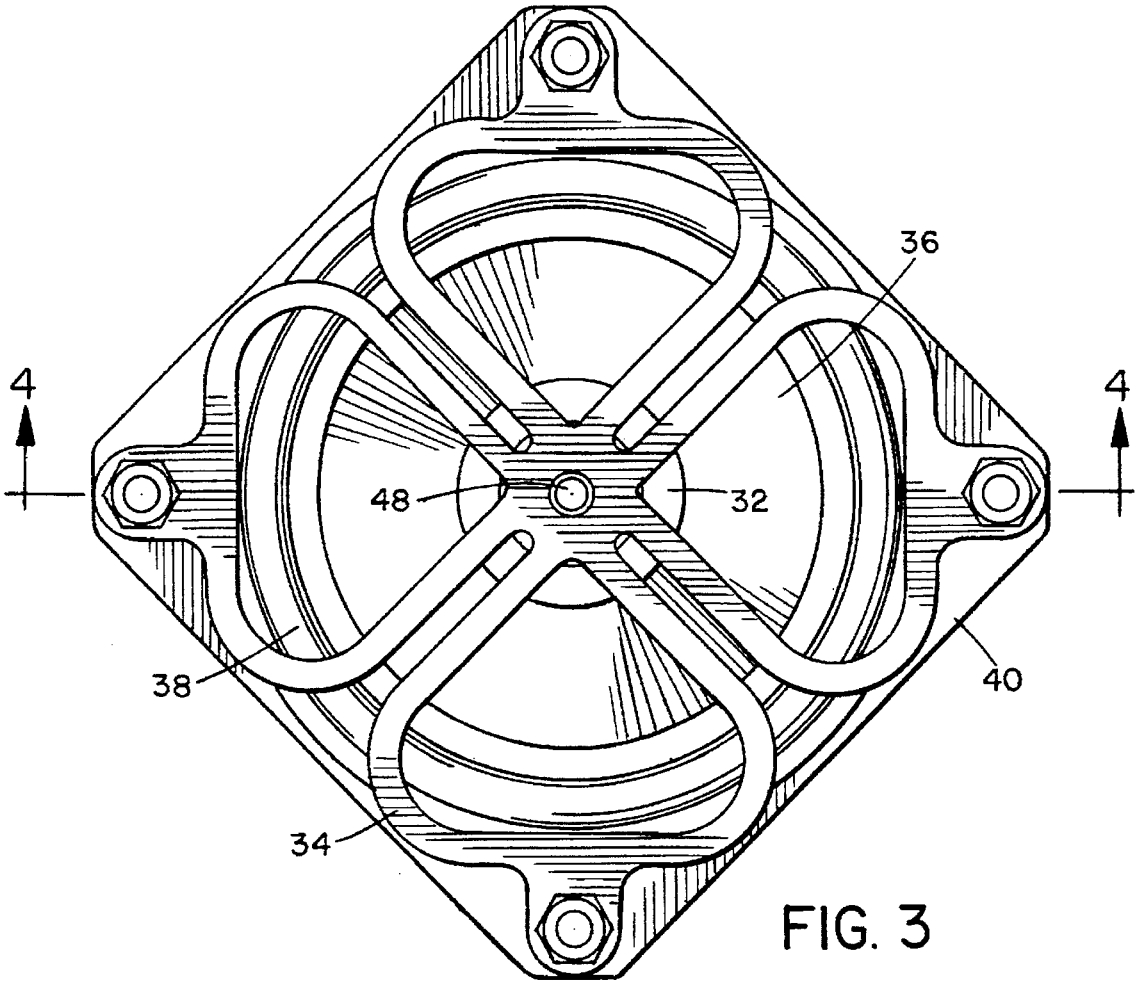
FIG. 3 is a top plan view of the electrodynamic shaker.
Figure 4:
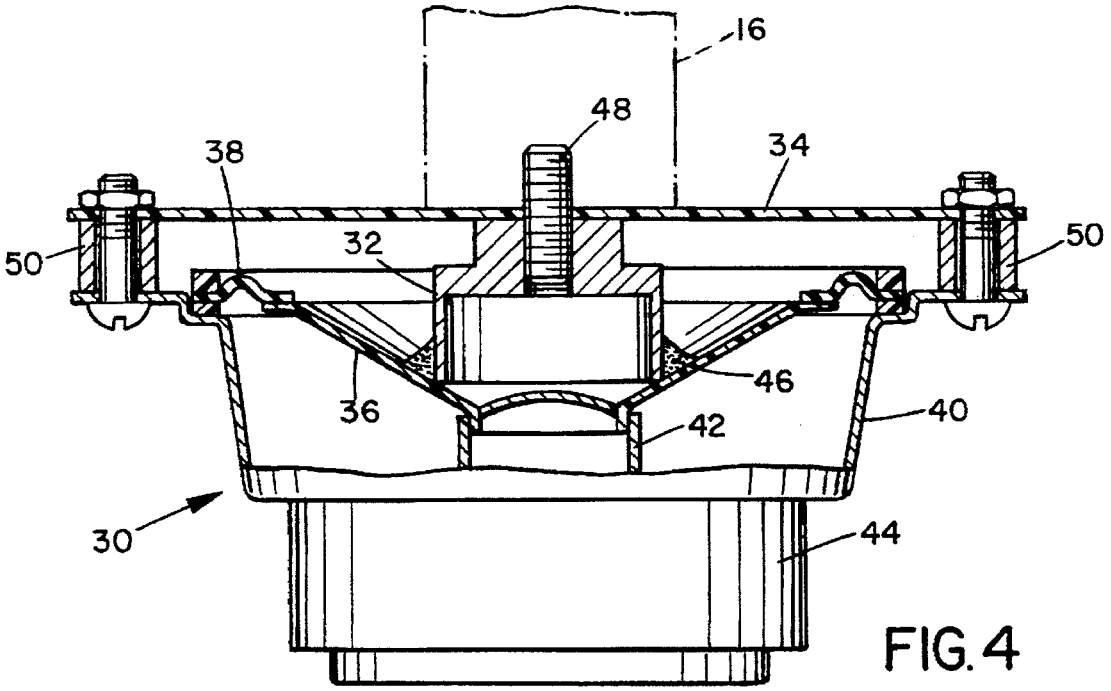
FIG. 4 is a sectional view taken along line 4—4 of FIG. 3.

As illustrated in FIGS. 3–4, shaker 10 comprises an audio speaker 30, a payload mounting 32, and a suspension spider 34. Although many types of common audio speakers may be suitable, speaker 30 preferably has a cone 36 that is made of a strong material, such as plastic, that will not easily be damaged by attaching payload mounting 32. Because cone 36 is made of a strong and thus relatively rigid material, speaker 30 may include a resilient ring 38 that connects the outer edge of cone 36 to the frame 40 to reduce resistance of cone 36 to axial movement. Other suitable speakers, however, may have other structures that provide similar advantages. The center of the lower surface of cone 36 is connected to a wire coil armature 42, which is suspended within an annular permanent magnet 44.

To assemble shaker 10, epoxy 46 is poured into the center of the upper surface of cone 36. One end of payload mounting 32 is disposed in the epoxy. The other end of payload mounting 32 has a threaded spindle 48 that extends through the hole in the center of suspension spider 34. Suspension spider 34 is mounted to frame 40 with standoffs 50, thereby centering payload mounting 32 in cone 36 while epoxy 46 hardens.

Referring briefly to FIGS. 1 and 2, the transducer test set may be used to vibrate a transducer-under-test 52. One end of reference accelerometer 16 has a threaded bore that is preferably screwed over threaded spindle 48. The other end of reference accelerometer 16 has a threaded bore into which transducer-under-test 52 may be screwed. In other embodiments that have no reference accelerometer, however, transducer-under-test 52 may be screwed directly over threaded spindle 48. Nevertheless, in the embodiment described herein, the threaded bore of accelerometer 16 extends through a hexagonal nut 54. Nut 54 should be gripped using a suitable wrench (not shown) while screwing transducer-under-test 52 into the threaded bore to avoid twisting cone 36 and damaging it.

Suspension spider 34 is made of a fiberglass-epoxy composite sheet, such as that used in manufacturing printed circuit boards. It moves resiliently in the direction of travel of cone 36 but is rigid in directions perpendicular to the direction of travel of cone 36. When reference accelerometer 16 is screwed onto threaded spindle 48, suspension spider 34 is held between it and payload mounting 32. Suspension spider 34 thus supports a portion of the combined weight of transducer-under-test 52, reference accelerometer 16, payload mounting 32, cone 36 and armature 42. Suspension spider 34 therefore maximizes the range of payload weights that shaker 10 can accommodate by minimizing the driving force that speaker 30 must apply to vibrate the payload.

Persons of skill in the art will readily appreciate that the range of payload weights that shaker 10 can accommodate is also dependent upon the power of the electrical signal driving speaker 30 and upon the size of speaker 30, including the power of permanent magnet 44, the size and number of windings in armature 42 and the diameter of cone 36. A speaker having a cone approximately four inches in diameter has been found to be suitable for testing industrial vibration-sensing transducers.

Shaker 10 is mounted below an opening in housing 14. A flexible diaphragm 56, through which nut 54 protrudes, covers the opening. Diaphragm 56 protects the components of the test set that are internal to housing 14 against damage from intrusion of dirt and foreign objects.

Obviously, other embodiments and modifications of the present invention will occur readily to those of ordinary skill in the art in view of these teachings. Therefore, this invention is to be limited only by the following claims, which include all such other embodiments and modifications when viewed in conjunction with the above specification and accompanying drawings.

I claim:

1. A vibrator for vibrating a transducer having a mount, comprising:

an audio speaker having a cone and a frame; and a payload mounting having a proximal end attached to said cone and a distal end selectably connectable to said mount.

2. The vibrator claimed in claim 1, wherein said payload mounting is threaded.

3. The vibrator claimed in claim 1, wherein said payload mounting is attached to said cone using an adhesive.

4. The vibrator claimed in claim 3, wherein said adhesive is epoxy.

5. A vibrator for vibrating a transducer having a mount, comprising:

a frame;

a permanent magnet having a generally annular shape rigidly mounted with respect to said frame;

a wire coil having a portion suspended within said magnet;

a flexible cone attached to said wire coil and said frame; and a payload mounting having a proximal end attached to said cone and a distal end selectably connectable to said mount.

6. The vibrator claimed in claim 5, wherein said payload mounting is attached to said cone using an adhesive.

7. The vibrator claimed in claim 6, wherein said adhesive is epoxy.

8. A test set for testing a transducer having a mount, comprising:

a housing;

an audio speaker in said housing having a cone;

a payload mounting having a proximal end attached to said cone and a distal end selectably connectable to said mount; and an oscillator circuit in said housing for driving said audio speaker at a predetermined frequency.

9. The test set claimed in claim 8, further comprising a reference accelerometer mounted on said payload mounting.

10. The test set claimed in claim 8, wherein said payload mounting is attached to said cone using an adhesive.

11. The test set claimed in claim 8, further comprising a flexible suspension member having a portion attached to said payload mounting and a portion rigidly mounted with respect to said housing.

12. A method for manufacturing a vibrator for testing a transducer having a mount, comprising the steps of:

disposing an adhesive in the center of the cone of an audio speaker; and disposing a proximal end of a payload mounting in said adhesive, said payload mounting having a distal end selectably connectable to said mount.

13. The method for manufacturing a vibrator claimed in claim 12, wherein said payload mounting is threaded.

14. A method for vibrating a transducer, comprising the steps of:

providing a vibrator comprising an oscillator circuit and an audio speaker having a cone and a frame, with a payload mounting attached to said cone, activation of said oscillator circuit providing a signal having an oscillation frequency to said audio speaker;

attaching said transducer to said payload mounting; and activating said oscillator circuit.

15. The method claimed in claim 14, wherein said providing step further comprises providing a vibrator comprising a reference accelerometer connected to said payload mounting.

16. A vibrator, comprising:

an audio speaker having a cone and a frame;

a payload mounting attached to said cone; and a suspension member having a portion attached to said payload mounting and a portion rigidly mounted with respect to said frame.

17. The vibrator claimed in claim 16, wherein said suspension member is made of fiberglass-epoxy composite.

18. The vibrator claimed in claim 17, wherein said suspension member has a cloverleaf shape.

19. A vibrator, comprising:

a frame;

a permanent magnet having a generally annular shape rigidly mounted with respect to said frame;

a wire coil having a portion suspended within said magnet;

a flexible cone attached to said wire coil and said frame;

a payload mounting attached to said cone; and a flexible suspension member having a portion attached to said payload mounting and a portion rigidly mounted with respect to said frame.

20. The vibrator claimed in claim 19, wherein said suspension member is made of fiberglass-epoxy composite.

21. The vibrator claimed in claim 20, wherein said suspension member has a cloverleaf shape.

22. A method for manufacturing a vibrator, comprising the steps of:

disposing an adhesive in the center of the cone of an audio speaker; and disposing a payload mounting in said adhesive; and attaching a portion of a flexible suspension member to said payload mounting and a portion of said suspension member to said speaker.

* * * * *